US007712286B2

(12) United States Patent
Negrini et al.

(10) Patent No.: US 7,712,286 B2
(45) Date of Patent: May 11, 2010

(54) MACHINE FOR PACKING CYLINDRICAL ARTICLES

(75) Inventors: Fausto Negrini, Castelfranco Emilia (IT); Roberto Marchetti, Castelmaggiore (IT); Ivanoe Bertuzzi, Casalecchio Di Reno (IT); Andrea Biondi, Bologna (IT)

(73) Assignee: G.D Societa'per Azioni, Bologna (IT)

( * ) Notice: Subject to any disclaimer, the term of this patent is extended or adjusted under 35 U.S.C. 154(b) by 72 days.

(21) Appl. No.: 11/858,422

(22) Filed: Sep. 20, 2007

(65) Prior Publication Data

US 2008/0066426 A1 Mar. 20, 2008

(30) Foreign Application Priority Data

Sep. 20, 2006 (IT) ..... BO2006A0645

(51) Int. Cl.
*B65B 19/34* (2006.01)
*B65B 35/30* (2006.01)

(52) U.S. Cl. ..... 53/148; 53/149; 53/447

(58) Field of Classification Search ..... 53/444, 53/447, 149, 153, 148
See application file for complete search history.

(56) References Cited

U.S. PATENT DOCUMENTS

| | | | | | |
|---|---|---|---|---|---|
| 3,589,099 | A * | 6/1971 | James | 53/526 |
| 3,642,112 | A | 2/1972 | Seragnoli | |
| 4,306,648 | A | 12/1981 | Manservisi et al. | |
| 5,016,424 | A * | 5/1991 | Stirling | 53/459 |
| 5,179,817 | A * | 1/1993 | Barnes et al. | 53/148 |
| 5,391,108 | A * | 2/1995 | Feldt | 452/21 |
| 5,467,576 | A * | 11/1995 | Hendriks | 53/437 |
| 5,636,498 | A * | 6/1997 | Belanger et al. | 53/444 |
| 5,975,301 | A * | 11/1999 | Stall et al. | 206/446 |
| 7,216,755 | B2 * | 5/2007 | Focke et al. | 198/418.1 |
| 2001/0003891 | A1 * | 6/2001 | Meis | 53/444 |
| 2005/0204706 | A1 * | 9/2005 | Spirito et al. | 53/444 |

FOREIGN PATENT DOCUMENTS

| | | |
|---|---|---|
| EP | 1 626 003 | 2/2006 |
| FR | 1 475 759 | 4/1967 |

* cited by examiner

*Primary Examiner*—Rinaldi I. Rada
*Assistant Examiner*—John Paradiso
(74) *Attorney, Agent, or Firm*—Oblon, Spivak, McClelland, Maier & Neustadt, L.L.P.

(57) ABSTRACT

A machine for packing cigarettes, having a group-forming device for forming a group of cigarettes, and a conveyor for feeding the group along a given path; the group-forming device has a number of seats, each for housing a respective subgroup of cigarettes; the subgroups are pushed, in use, through respective insertion channels tapering towards the conveyor, into a pocket of the conveyor to define the group of cigarettes; and the pocket has a substantially triangular cross section parallel to the path.

20 Claims, 7 Drawing Sheets

MACHINE FOR PACKING CYLINDRICAL ARTICLES

The present invention relates to a machine for packing cylindrical articles, and to a group-forming device for forming groups of cylindrical articles.

The present invention may be used to advantage for packing cigarettes, to which the following description refers purely by way of example.

More specifically, the present invention relates to a machine for packing cylindrical articles in the tobacco industry, and which comprises a group-forming device for forming a group of cylindrical articles. The group-forming device in turn comprises a substantially vertical hopper; a conveying device comprising at least one pocket for housing the group of cylindrical articles; and a transfer device for transferring the cylindrical articles from the hopper to the conveying device. The transfer device comprises a push member for pushing a first and at least a second subgroup of cylindrical articles, crosswise to the feed direction, into the pocket at a first and second insertion station respectively; and the second subgroup is inserted, in use, into the pocket on top of the first subgroup to define the group of cylindrical articles.

Examples of machines of the above type for packing cylindrical articles are described in U.S. Pat. No. 3,707,219 and EP1002722A1.

U.S. Pat. No. 5,590,513 describes a cigarette packing machine comprising a group-forming device for forming a group of cigarettes. The group-forming device in turn comprises a substantially vertical hopper housing a mass of downward-fed cigarettes; and a transfer device for transferring a group of cigarettes from the hopper into a folding spindle. And the folding spindle has movable lateral walls for compressing the group of cigarettes.

BACKGROUND OF THE INVENTION

Known cigarette packing machines of the above types have the drawback of being unable to satisfactorily pack substantially triangular groups of cigarettes.

In this connection, it is important to note that, being highly unstable, on account of the relative positions of the cigarettes, triangular groups of cigarettes are relatively difficult to handle. To produce packets of triangular groups of cigarettes, therefore, it is essential that means be provided—which are not, on known machines—to maintain the relative positions of the cigarettes, while at the same time adequately preparing the groups for wrapping (normally in a foil wrapping).

SUMMARY OF THE INVENTION

It is an object of the present invention to provide a machine for packing cylindrical articles, and a group-forming device for forming groups of cylindrical articles, designed to at least partly eliminate the aforementioned drawbacks, and which at the same time are cheap and easy to produce.

According to the present invention, there are provided a machine for packing cylindrical articles, and a group-forming device for forming groups of cylindrical articles, as claimed in the attached Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
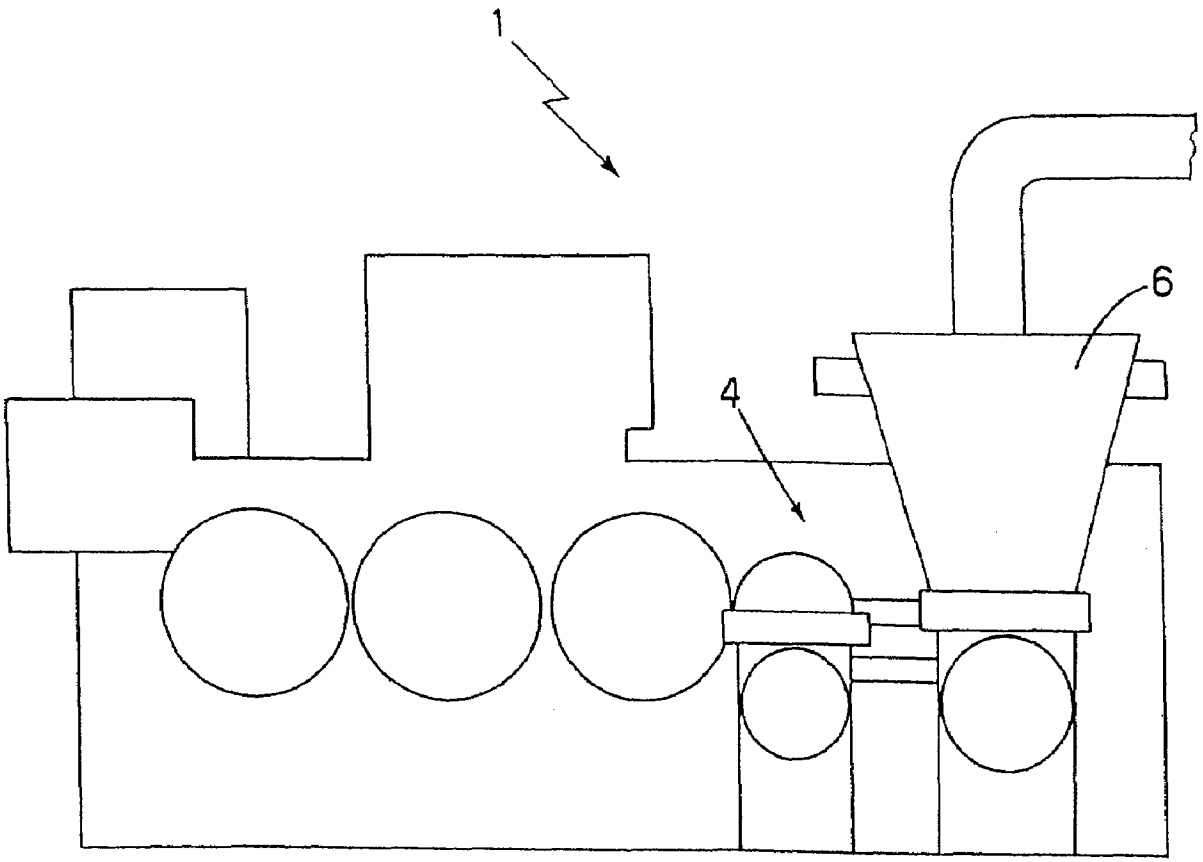
FIG. 1 shows a schematic front view of a cigarette packing machine in accordance with the present invention.
Figure 2:
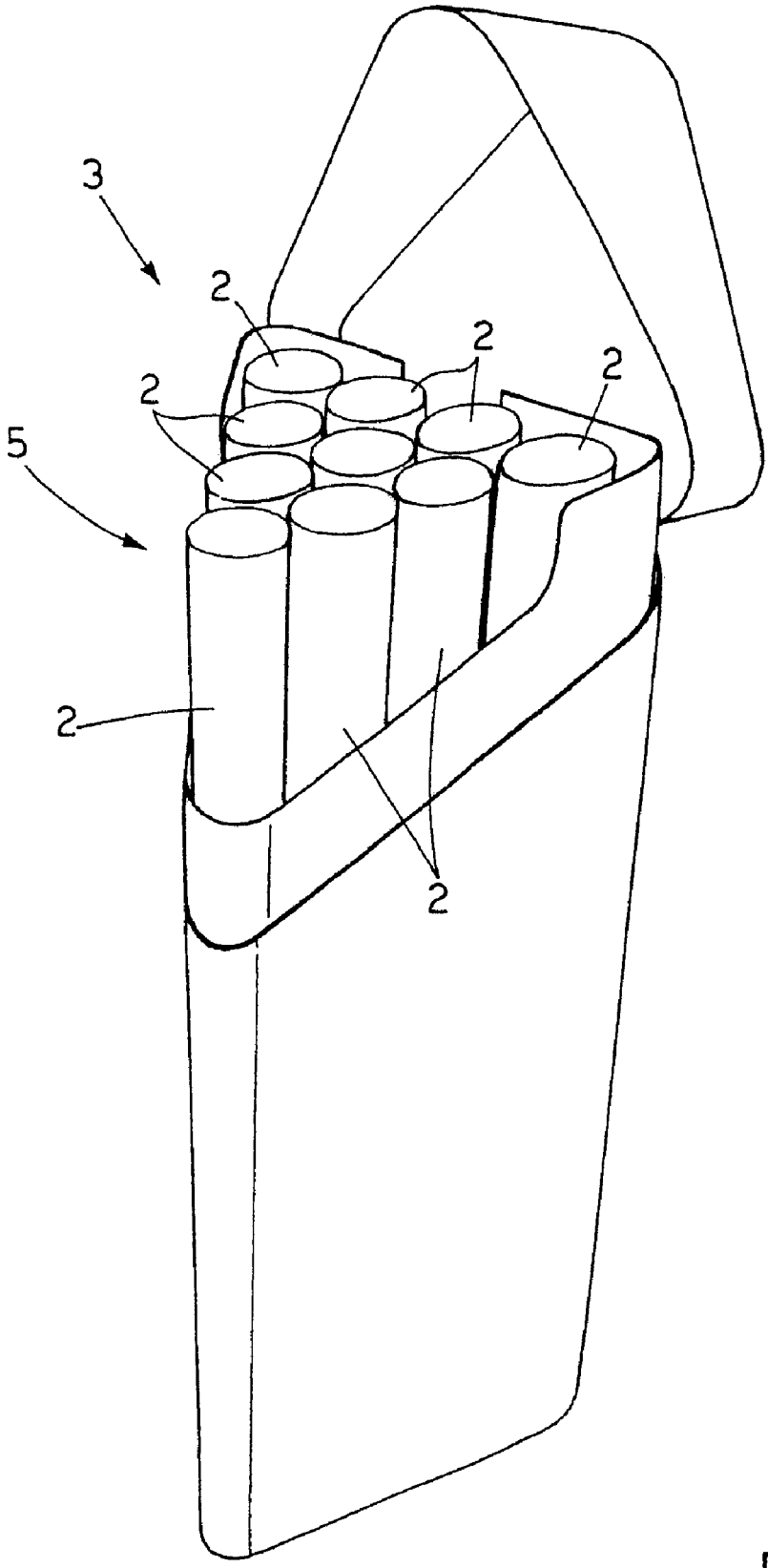
FIG. 2 shows a view in perspective of a packet of cigarettes producible on the FIG. 1 machine.
Figure 3:
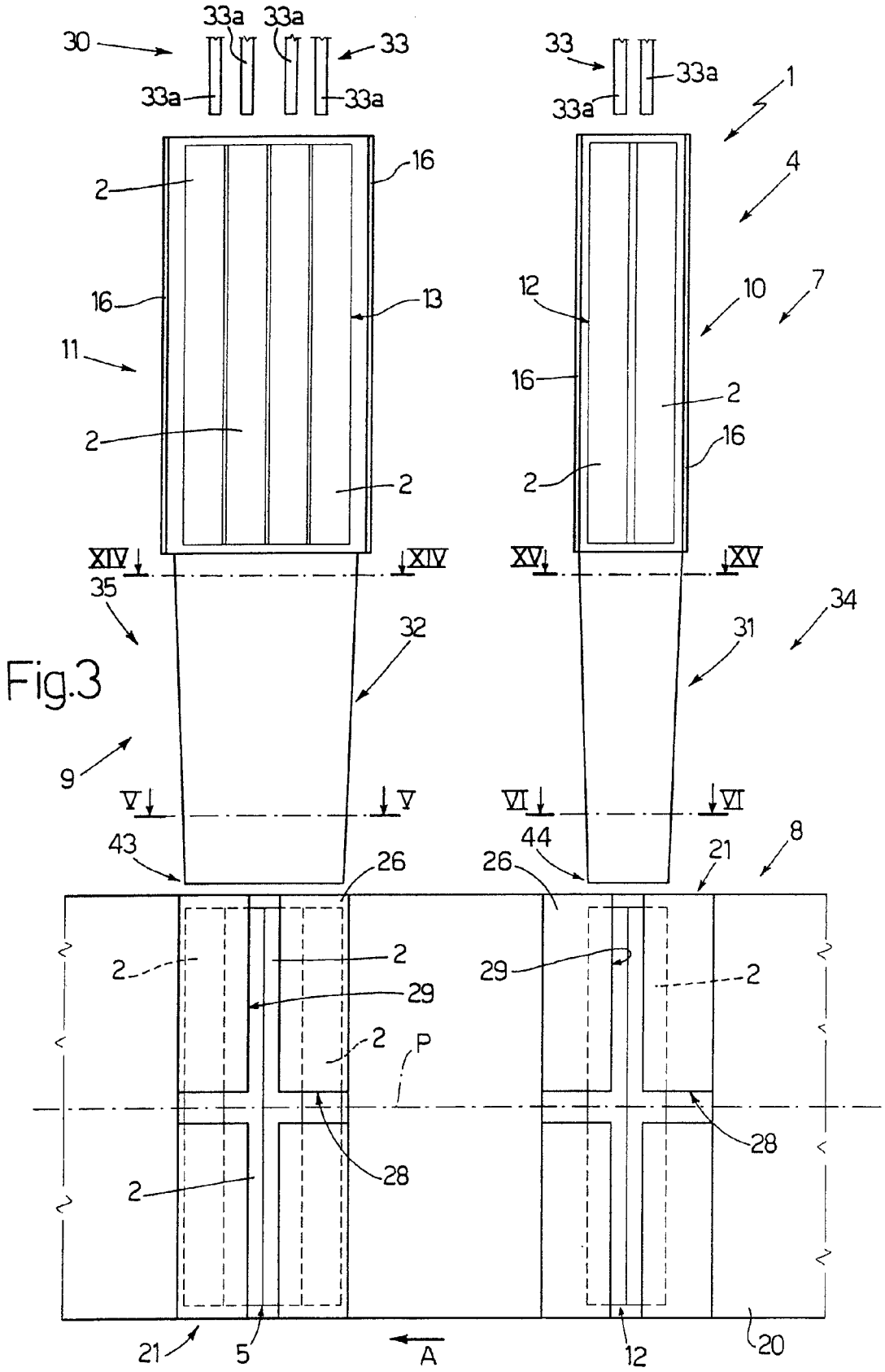
FIG. 3 shows a schematic top plan view, with parts removed for clarity, of a portion of the FIG. 1 machine.
Figure 4:
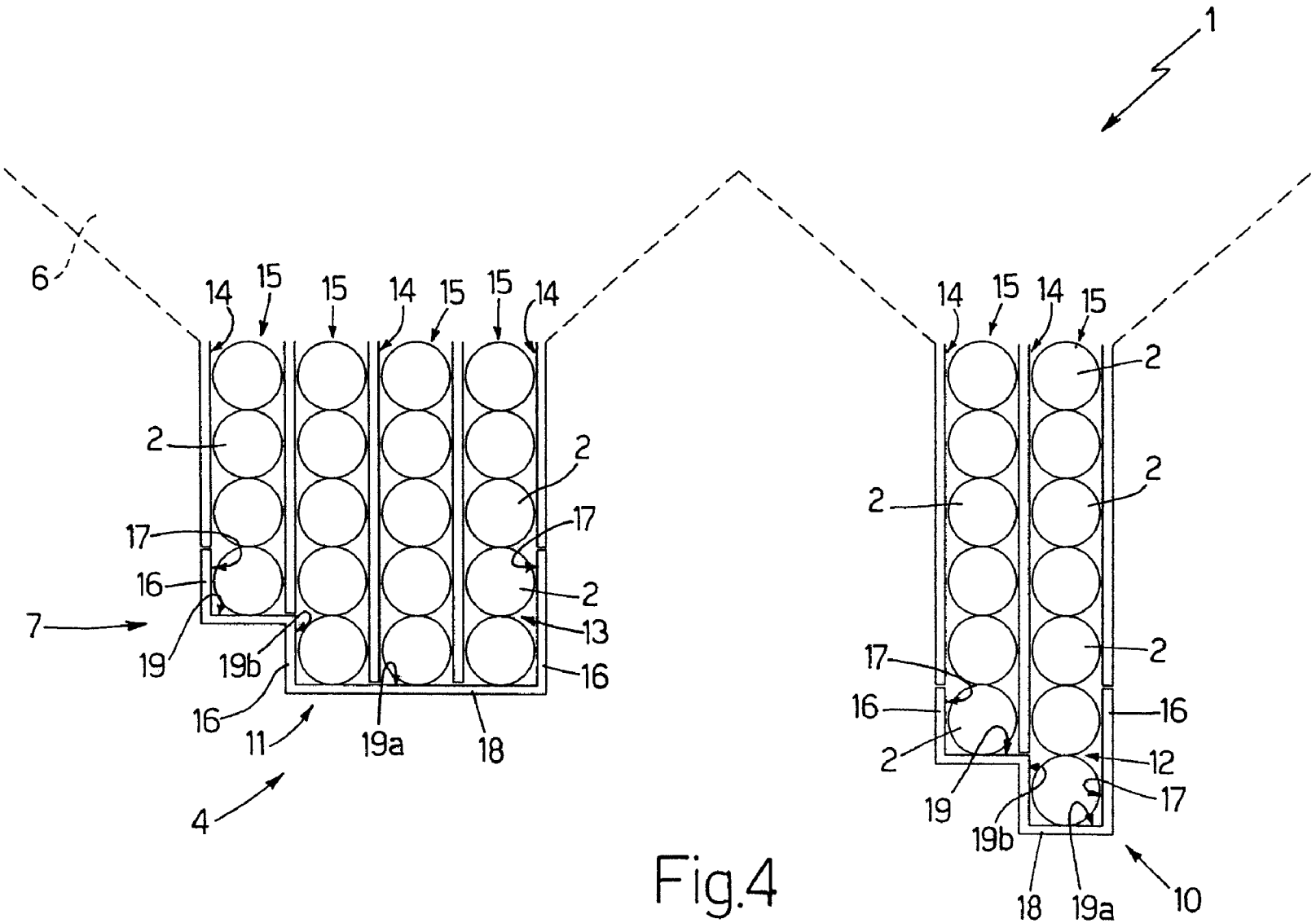
FIG. 4 shows a schematic front view of a portion of the FIG. 1 machine.

Number 1 in FIG. 1 indicates as a whole a machine for packing cylindrical articles, in particular cigarettes 2, to form a packet 3 of cigarettes 2 (FIG. 2). With particular reference to FIGS. 3 and 4, machine 1 comprises a group-forming device 4 for forming a group 5 of cigarettes 2, and which comprises a substantially vertical hopper 6 for housing and feeding a mass of cigarettes 2 downwards to a transfer station 7, a conveyor 8 for feeding group 5 from station 7 along a path P in a given direction A, and a transfer device 9 for transferring cigarettes 2 from hopper 6 to conveyor 8.

Device 9 comprises a number of—in the example shown, two—seats 10 and 11 located at the transfer station, and each for receiving from hopper 6 a respective subgroup 12, 13 of cigarettes 2; each subgroup 12, 13 comprising at least one cigarette 2.

At the bottom, hopper 6 comprises a number of channels 14, along each of which a column 15 of single cigarettes 2 travels, in use. Each seat 10, 11 is located beneath at least one channel 14, and contains a respective number of cigarettes 2 different from the number of cigarettes 2 in the other seat 11, 10. In the embodiment shown, seat 10 is located beneath two channels 14, and houses a subgroup 12 comprising three cigarettes 2; and seat 11 is located beneath four channels 14, and houses a subgroup 13 comprising seven cigarettes 2.

The fact that each seat 10, 11 contains a respective number of cigarettes 2, different from the number of cigarettes 2 in the other seat 11, 10, provides for forming group 5 relatively easily.

Each seat 10, 11 comprises two lateral walls 16, each of which is substantially vertical and has an inner surface 17. And each seat 10, 11 comprises a bottom wall 18 having a substantially horizontal top supporting surface 19 and a substantially horizontal bottom supporting surface 19*a* connected to each other by a respective substantially vertical surface 19*b*.

An optional known vibrating member (not shown) is provided at seats 10, 11 to vibrate seats 10, 11 to ensure correct insertion of cigarettes 2 inside seats 10, 11.

Conveyor 8 comprises a belt 10 travelling in direction A and looped about two pulleys (not shown); and at least one pocket 21 fitted integrally to belt 20 to travel along path P in direction A.

Figure 7:
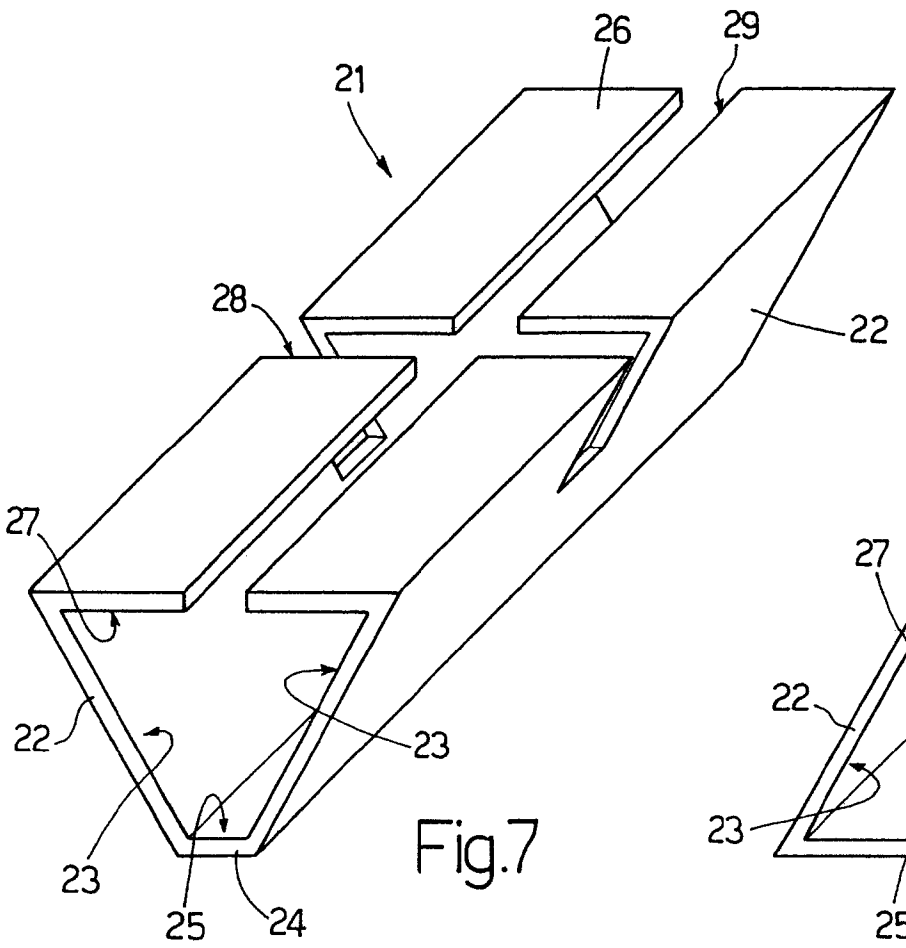
FIG. 7 shows a view in perspective of a detail of the FIG. 1 machine.

With particular reference to FIG. 7, pocket 21 comprises two lateral walls 22, each having an inner lateral surface 23; a bottom wall 24 having an inner bottom surface 25; and a top wall 26 having an inner top surface 27. Surfaces 23 are crosswise to the given direction, and slope towards each other so that group 5 assumes a substantially triangular shape inside pocket 21. More specifically, surfaces 23 slope so that the space defined inside pocket 21 by surfaces 23, 25 and 27 tapers downwards.

Pocket 21 comprises a slit 28 crosswise to surfaces 23, substantially parallel to direction A, and defining openings in lateral walls 22 and top wall 26; and a slit 29 crosswise to slit 28 and defining an opening in top wall 26.

Figure 5:
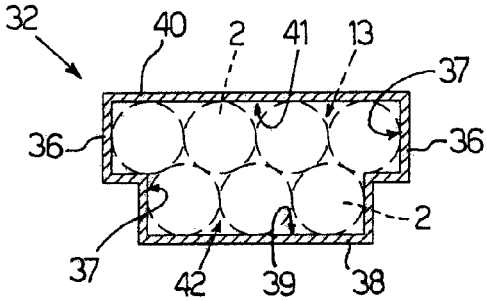
FIGS. 5 and 6 show sections along lines V and VI, respectively, of the FIG. 3 portion.
Figure 6:
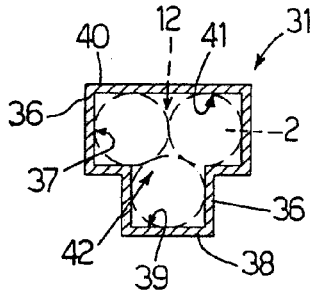

With particular reference to FIGS. 3, 5 and 6, device 4 also comprises a push member 30 for pushing subgroups 12, 13 longitudinally, and crosswise to direction A, through respective insertion channels 31, 32 into pocket 21. Push member 30 comprises two pushers 33 comprising a number of push fingers 33*a* (some of fingers 33*a* are shown in FIG. 3); and each finger 33*a* is movable longitudinally, and crosswise to direction A, to push a respective cigarette 2 into pocket 21.

Each channel 31, 32 is located at a respective insertion station 34, 35, and comprises two lateral walls 36, each having an inner surface 37; a bottom wall 38 having an inner bottom surface 39; and a top wall 40 having an inner top surface 41.

Inner top surfaces 41 are designed to exert downward pressure on cigarettes 2 in respective subgroups 12, 13, as subgroups 12, 13 are pushed, in use, towards path P.

Each channel 31, 32 is shaped so that the inner cavity 42 defined by surfaces 37, 39, 41 tapers towards path P, and the cigarettes 2 in subgroup 12, 13 are therefore brought closer together and/or compacted as they travel along relative insertion channel 31, 32 towards conveyor 8.

Channel 32 has one end 43 facing path P at a higher level than a similar end 44 of channel 31, so that, in use, subgroup 13 is inserted into pocket 21 on top of subgroup 12.

Figure 14:
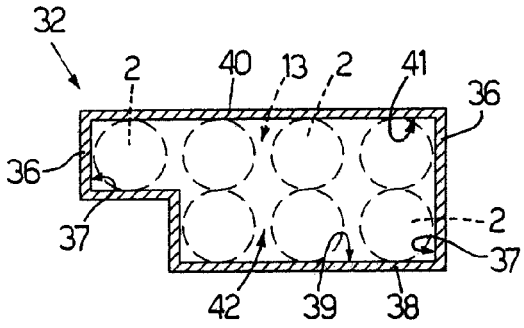
FIGS. 14 and 15 show sections along lines XIV and XV, respectively, of the FIG. 3 portion.
Figure 15:
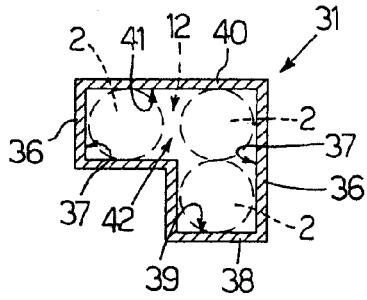

It is important to note that the cross sections, parallel to direction A, of cavities 42 vary. More specifically, the respective cross sections, parallel to direction A, of cavities 42 are substantially T-shaped (FIGS. 5 and 6) at ends 43 and 44, and are substantially L-shaped (FIGS. 14 and 15) at the opposite ends to ends 43 and 44. This particular design of cavities 42 provides for positioning cigarettes 2 in each subgroup 12, 13 correctly with respect to one another, as cigarettes 2 are fed from hopper 6 to conveyor 8.

Figure 9:
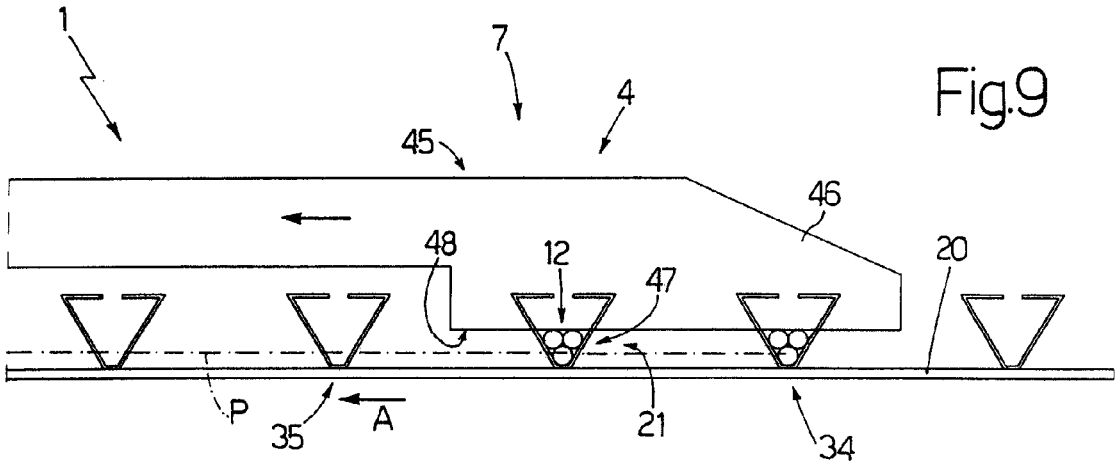
FIGS. 9 to 11 show schematics of a portion of the FIG. 1 machine at different operating stages.
Figure 10:
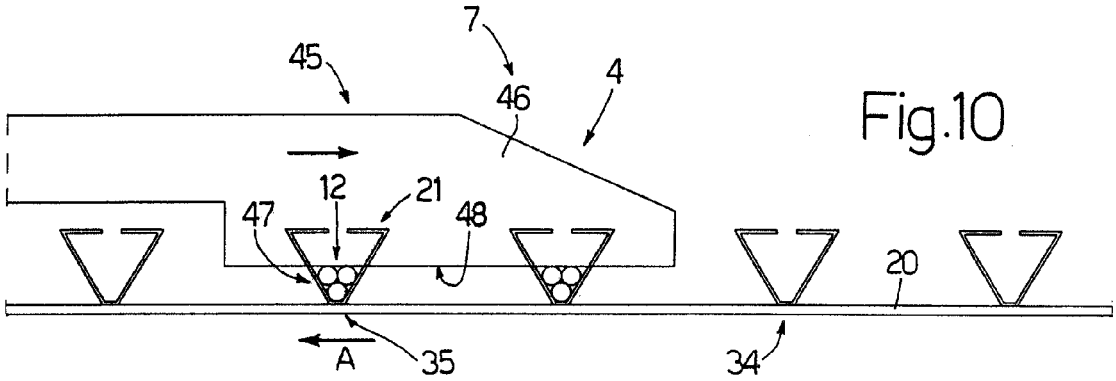
Figure 11:
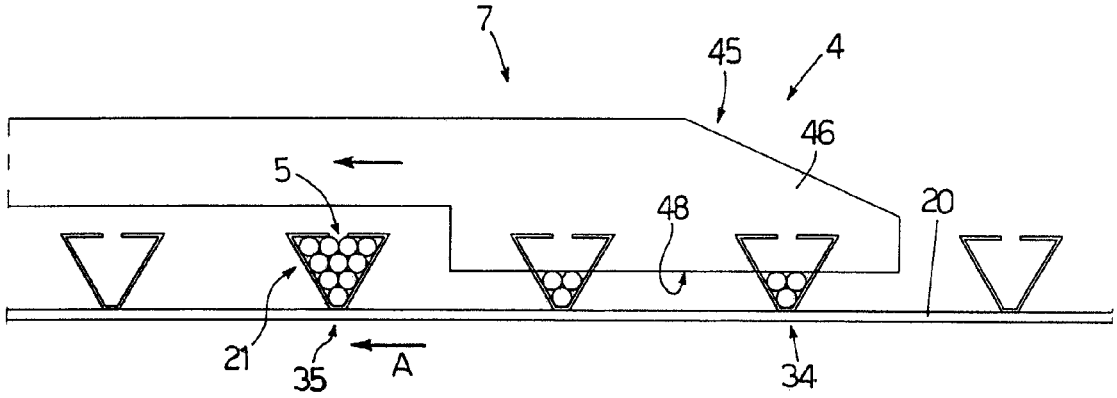

With particular reference to FIGS. 9 to 11, device 4 also comprises a stabilizing device 45 for keeping subgroup 12 positioned correctly inside pocket 21 as pocket 21 travels, in use, along path P between stations 34 and 35. Device 45 has the same structure and operates in the same way as the stabilizing device described in U.S. Pat. No. 3,642,112, to which full reference is made herein. More specifically, device 45 comprises a retaining member 46, which at least partly engages slit 28 to define the top of a portion 47 of pocket 21 housing subgroup 12. And retaining member 46 has a bottom pressure surface 48 for pressing down on subgroup 12.

Device 45 also comprises actuating members (not shown) for moving retaining member 46, in time with pocket 21, along path P from station 34 to station 35 (FIG. 9), and, once pocket 21 reaches station 35 (FIG. 10), for returning retaining member 46 to station 34 (FIG. 11).

Device 4 preferably comprises a known control unit (not shown) for coordinating push member 30 and the actuating members (not shown), so that retaining member 46 begins disengaging the slit when subgroup 13 is at least partly inserted inside pocket 21.

Operation of machine 1 will now be described briefly, as of the instant in which subgroup 12 is correctly positioned inside seat 10.

At this point, push member 30 pushes subgroup 12 through insertion channel 31 into pocket 21; and subgroup 12 is kept positioned correctly inside pocket 21 by retaining member 46, which moves together with pocket 21 from station 34 to station 35.

When pocket 21 reaches station 35, subgroup 13, formed in the meantime inside seat 11, is pushed through channel 32 into pocket 21 and on top of subgroup 12 to form group 5. As subgroup 13 begins engaging pocket 21, retaining member 46 is withdrawn from station 35 to station 34 to disengage slit 28 and avoid interfering with insertion of subgroup 13.

In the above embodiment, group 5 of cigarettes 2 is substantially triangular with its apex facing downwards.

Figure 8:
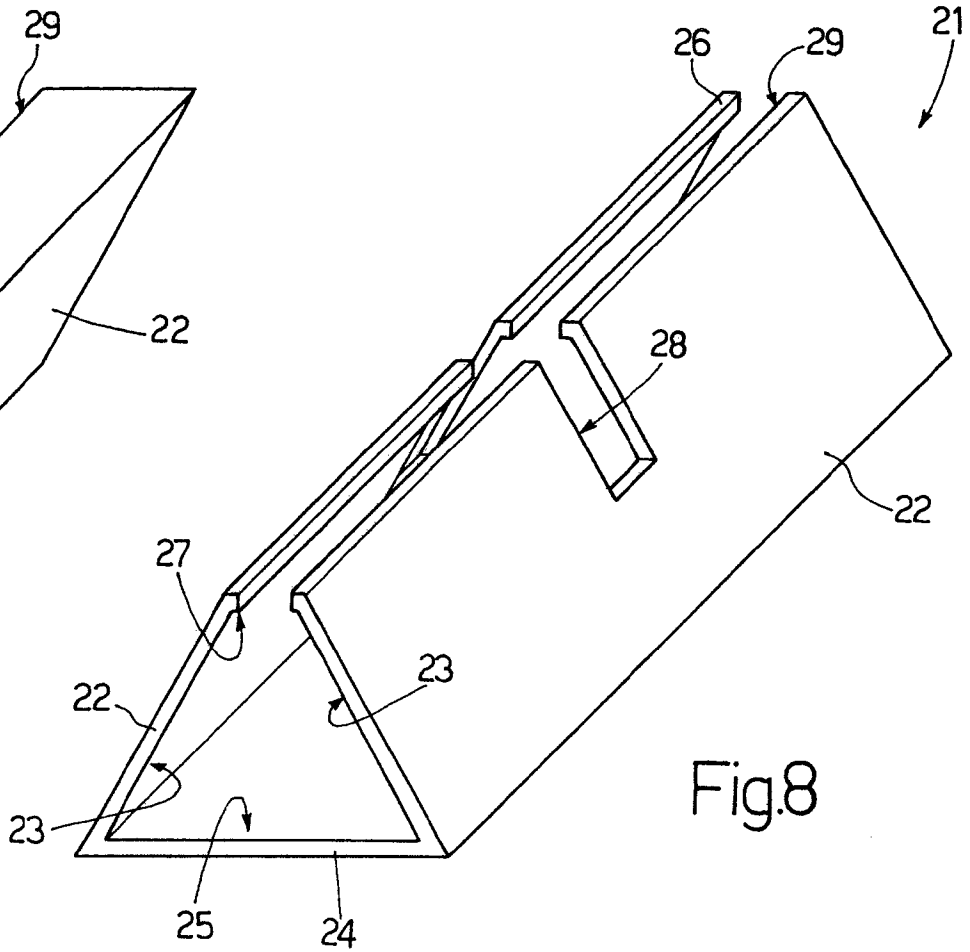
FIG. 8 shows a view in perspective of an alternative embodiment of the FIG. 7 detail.

In a further embodiment, group 5 is formed with its apex facing upwards. In which case, hopper 6 is equipped with mechanical fingers (not shown) for selectively closing some of channels 14 to form, inside seats 10 and 11, superimposed layers (not shown) of decreasing numbers of cigarettes 2 (i.e. layers in which the top layer comprises a smaller number of cigarettes 2 than the underlying layer). The pocket 21 of this further embodiment is shown in FIG. 8.

Though the above description relates to a packet 3 of ten cigarettes 2, the teachings of the present invention obviously also apply to packets containing a different number of cigarettes 2.

Figure 12:
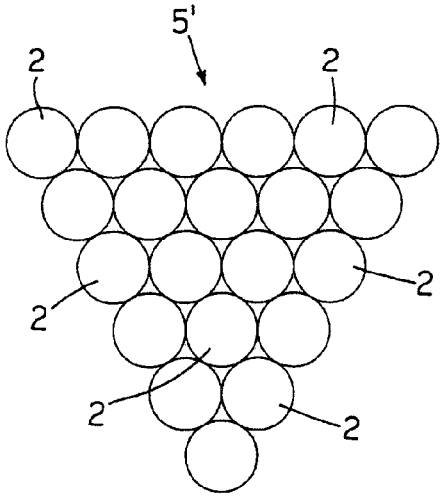
FIGS. 12 and 13 show top plan views of groups of cigarettes of two further shapes packable on a machine in accordance with the present invention.
Figure 13:
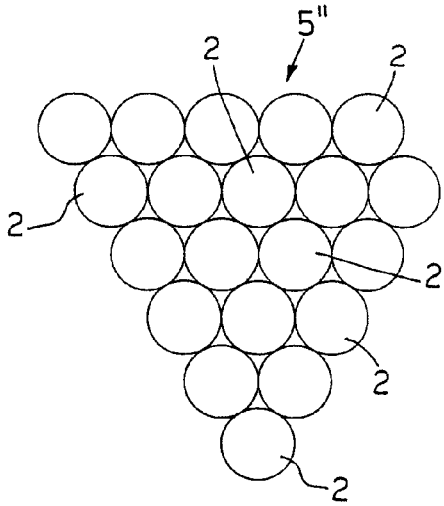

Purely by way of example, FIGS. 12 and 13 show respective groups 5' and 5" of cigarettes 2 of two further shapes that can be produced and packed in accordance with the present invention. More specifically, group 5' comprises twenty-one cigarettes 2, and group 5" twenty cigarettes 2.

The above embodiments may also obviously be modified to form subgroups 12, 13 comprising a different number of layers of cigarettes 2. More specifically, in an embodiment not shown, to form groups 5" of twenty cigarettes 2, each subgroup 12, 13 comprises three layers of cigarettes 2. In which case, subgroup 12 comprises six, and subgroup 13 fourteen, cigarettes 2.

The invention claimed is:

1. A machine for packing cylindrical articles of the tobacco industry, the machine comprising:

a group-forming device for forming a group of cylindrical articles;

the group-forming device in turn comprising a substantially vertical hopper containing a mass of cylindrical articles fed downwards, in use, to a transfer station, a conveyor for feeding the group of cylindrical articles from the transfer station along a path in a given direction, and a transfer device located at the transfer station and for transferring the cylindrical articles from the hopper to the conveyor;

the conveyor comprising at least one pocket for housing the group of cylindrical articles;

the transfer device comprising at least one push member to push a first and at least a second subgroup of cylindrical articles, crosswise to the given direction, into the pocket at a first and second insertion station respectively, the second insertion station downstream from the first insertion station;

the pocket comprises first inner lateral surfaces crosswise to the given direction and so shaped that the group of cylindrical articles assumes a substantially triangular shape inside the pocket;

the transfer device comprising a first insertion channel located at the first insertion station between the hopper and the conveyor, and at least a second insertion channel located at the second insertion station between the hopper and the conveyor;

the first and the second insertion channel each having a cavity tapering towards the conveyor, so that the cylindrical articles in the first and second subgroup, respectively, are brought closer together and/or compressed as they travel towards the pocket; and the first and the second insertion channels be so positioned that the second subgroup is inserted into the pocket on top of the first subgroup to define the group of cylindrical articles assuming the substantially triangular shape inside the pocket.

2. A machine as claimed in claim 1, wherein the first and the second subgroup each comprise at least two superimposed layers of cylindrical articles.

3. A machine as claimed in claim 1, wherein at least one of the first and second insertion channel has a cavity whose cross sections, parallel to the given direction, vary in shape.

4. A machine as claimed in claim 3, wherein at least one of the cavities of the first and second insertion channel has at least a substantially L-shaped cross section parallel to the given direction.

5. A machine as claimed in claim 3, wherein at least one of the cavities of the first and second insertion channel has at least a substantially T-shaped cross section parallel to the given direction.

6. A machine as claimed in claim 1, wherein the first and second insertion channel each comprise a top inner surface at least partly defining the top of the relative cavity.

7. A machine as claimed in claim 6, wherein at least one top inner surface is designed to exert downward pressure on the cylindrical articles in the respective subgroup as the subgroup is pushed, in use, towards the path.

8. A machine as claimed in claim 1, and comprising a stabilizing device adapted to keep the first subgroup positioned correctly inside the pocket as the pocket travels, in use, along the path between the first and second insertion station.

9. A machine as claimed in claim 8, wherein the stabilizing device comprises a retaining member defining the top of a portion of the pocket; said portion being adapted to house the first subgroup.

10. A machine as claimed in claim 9, wherein the retaining member has a bottom pressure surface for pressing down on the first subgroup.

11. A machine as claimed in claim 9, wherein the stabilizing device comprises actuating members, which are adapted to move the retaining member, in time with the pocket, along the path from the first to the second insertion station.

12. A machine as claimed in claim 11, wherein the actuating members are adapted to impart a back and forth movement to the retaining member, so that, in use, once the pocket reaches the second insertion station, the retaining member moves back to the first insertion station.

13. A machine as claimed in claim 9, wherein the pocket comprises a slit crosswise to the inner lateral surfaces; the retaining member being adapted to at least partly engaging engage the slit as the pocket travels along the path between the first and second insertion station.

14. A machine as claimed in claim 13, and comprising a control unit adapted to coordinate the push member and the actuating members, so that the retaining member begins disengaging the slit when the second subgroup is at least partly inserted inside the pocket.

15. A machine as claimed in claim 9, wherein the pocket comprises a further portion, which is located above said portion and is adapted to house the second subgroup.

16. A machine as claimed in claim 1, wherein the cavities of the first and second insertion channel are of different extent so that the first subgroup comprises a number of cylindrical articles which differs from the number of cylindrical articles of the second subgroup.

17. A machine as claimed in claim 1, wherein the pocket is designed to define a downward-tapering space inside.

18. A group-forming device for forming a group of cylindrical articles, as claimed in claim 1.

19. A machine as claimed in claim 1, wherein two inner lateral surfaces of the pocket slope towards each other so that the group of the cylindrical articles assumes the substantially triangular shape inside the pocket.

20. A machine as claimed in claim 1, wherein the pocket is designed so as to define a substantially triangular space inside.

* * * * *